United States Patent [19]

Roosa

[11] Patent Number: 4,915,235

[45] Date of Patent: Apr. 10, 1990

[54] TEAR PANEL FRENCH FRY CARTON

[75] Inventor: Paul D. Roosa, Saugerties, N.Y.

[73] Assignee: International Paper Company, Purchase, N.Y.

[21] Appl. No.: 350,965

[22] Filed: May 12, 1989

[51] Int. Cl.[4] ..... B65D 5/54

[52] U.S. Cl. ..... 206/611; 206/607; 229/1.5 B; 229/8; 229/193; 229/902

[58] Field of Search ..... 206/607, 611, 620; 229/1.5 B, 8, 16 A, 902, 906

[56] References Cited

U.S. PATENT DOCUMENTS

| | | | |
|---|---|---|---|
| 2,133,701 | 10/1938 | Holmes et al. | 229/16 A |
| 2,577,007 | 12/1951 | Dubilier | 229/16 A |
| 2,966,293 | 12/1960 | Goldsholl | 229/8 |
| 3,315,875 | 4/1967 | Praetorius | 206/611 |
| 3,324,998 | 6/1967 | Farquhar . | |
| 3,637,130 | 1/1972 | Farquhar | 229/52 B |
| 4,344,537 | 8/1982 | Austin | 206/611 |
| 4,388,993 | 6/1983 | Lavery | 206/611 |
| 4,498,581 | 2/1985 | Dutcher | 206/611 |
| 4,511,042 | 4/1985 | Wischusen | 206/611 |
| 4,584,202 | 4/1986 | Roccaforte | 206/611 |
| 4,711,389 | 12/1987 | Alba et al. | 229/1.5 B |
| 4,714,190 | 12/1987 | Morrocco | 229/1.5 B |
| 4,746,019 | 5/1988 | Prater | 206/611 |

*Primary Examiner*—Gary Elkins

*Attorney, Agent, or Firm*—Walt Thomas Zielinski

[57] ABSTRACT

A frence fry scoop/container formed from a unitary blank of paperboard. One sidewall of the container has a projecting tongue which functions both as a scoop and as a resilient or snap top closure. The second sidewall is provided with two parallel rows of tear perforations, to enable its major portion to be torn away. When the filled scoop/container is laid flat on the first sidewall, the second sidewall is ripped away, thereby exposing the entire stack of contents (french fries) and thus enabling the purchaser to add any desired additional condiments to the french fries.

7 Claims, 3 Drawing Sheets

TEAR PANEL FRENCH FRY CARTON

BACKGROUND OF THE INVENTION

This invention relates to a french fry scoop fashioned from a unitary blank of paperboard, the blank being provided with fold lines and having portions glued together to form the scoop. The prior art is aware of french fry scoops of this general type, such as may be seen by U.S. Pat. No. 4,711,389, issued to Alba et al. In general, such scoops are fashioned from a unitary blank of paperboard having two main side forming panels and a central, bottom forming panel which is integral with both of the two main panels. The main panels are folded relative to the bottom panel to form a kind of truncated conical container which is then used as a combination scoop and serving container for french fries in fast food outlets.

While generally satisfactory as a french fries scoop and serving container, such typical prior art constructions have one particular drawback. Namely, if the purchaser wishes to season the french fries with additional salt or pepper or ketchup or other condiment, such additional flavorings can only be applied to the french fries by sprinkling or pouring them on the open end of the container. While the french fries near the open end receive the condiments, those in the middle and lower portions do not, with the result that the consumer must continually apply such condiments as the contents of the scoop/container are picked off from the top and eaten.

SUMMARY OF THE INVENTION

The french fry scoop and serving container of this invention permits the user to place the container on a flat surface, rip away nearly all of one of its sides and thereby completely expose the french fries therein and thus permit the consumer to uniformly apply condiments to the entire mass or stack of french fries. The scoop of this invention, additionally, has a projecting scoop or tongue portion which can be folded back to assist in keeping the french fries in the scoop during carrying by the consumer.

DETAILED DESCRIPTION OF THE INVENTION

Figure 1:
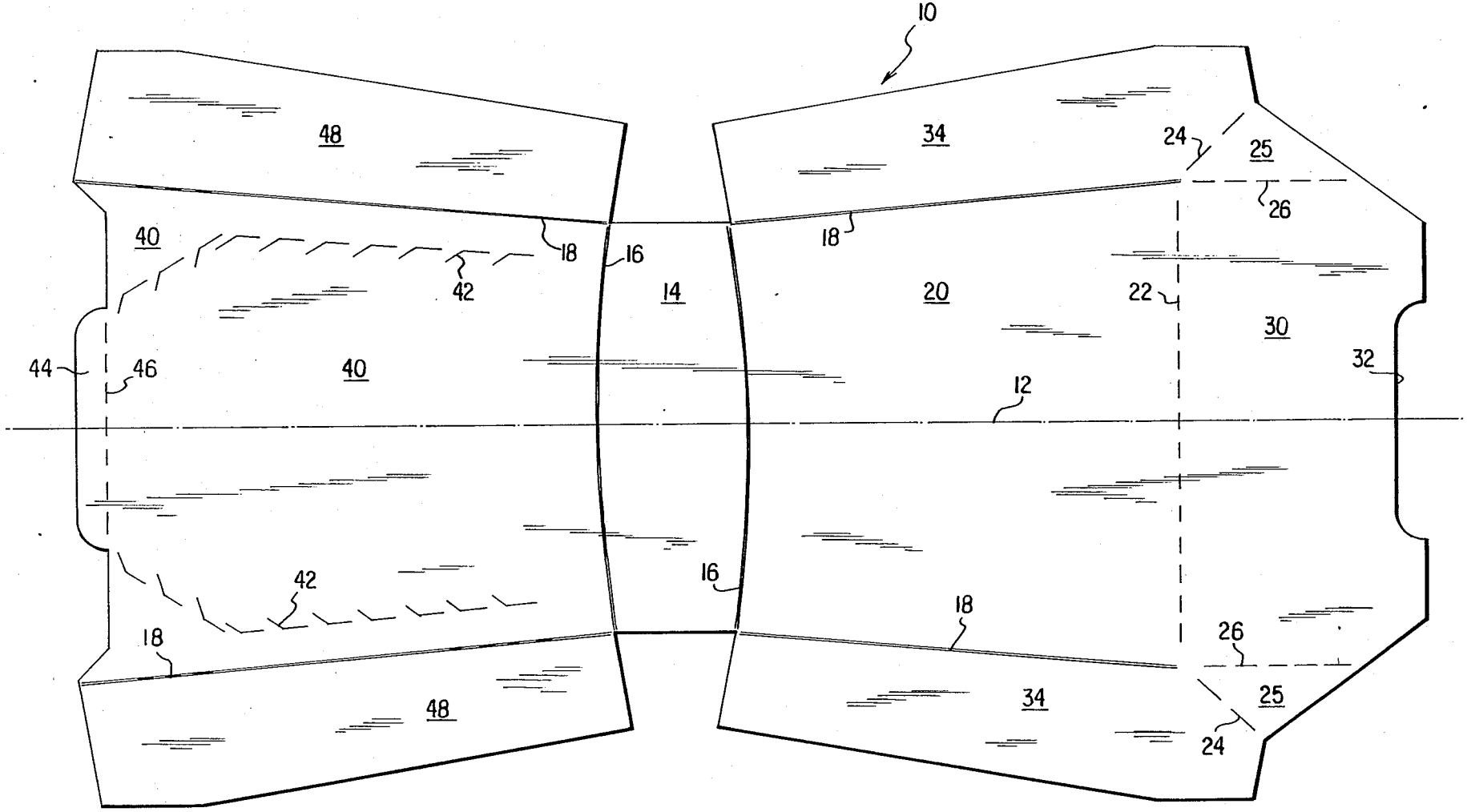
FIG. 1 is a plan view of a unitary paperboard blank from which the french fry scoop and container of this invention is formed.

Referring now to FIG. 1 of the drawings, the numeral 10 denotes generally a unitary paperboard blank from which the french fry scoop, container of this invention, is fashioned. Other sheet materials which are stiff, resilient, and foldable may be used instead of paperboard. The numeral 12 denotes generally a longitudinal axis of the blank, the blank exhibiting mirror symmetry about axis 12. The numeral 14 denotes the bottom forming panel of the container, the panel being in the general form a rectangle having slightly convex longitudinal sides. The long sides of the rectangle are provided with curved score lines 16, to thereby permit adjacent side forming panels to be folded relative to panel 14. The numeral 20 denotes a first sidewall panel of generally slightly divergent rectangular form, defined on its left by score or fold lines 16 and on upper and lower edges by fold lines 18. The numeral 22 denotes a perforated line extending transversely of longitudinal axis 12 and generally between the right ends of fold lines 18. The numerals 24 and 26 denote diverging perforated lines extending from the right ends of fold lines 18 of panel 20, these latter perforated lines defining triangular panels 25. The numeral 30 denotes a top closure sub-panel formed from the right hand portion of side panel 20, this portion being measured to the right of perforated line 22. Triangular panels 25 are termed fold panels and are each defined by perforated lines 24, 26 and a respective portion of the free edge of sub-panel 30. The right hand or free edge of panel 30 is provided with a recess 32. Upper and lower end forming flaps 34 are foldably located at the longitudinal edges of panel 20.

The numeral 40 denotes a second similar sidewall panel, this latter panel provided with two perforated ripping lines 42 which extend from a region near the right hand end of panel 40 towards its left free edge and then converging towards axis 12. The numeral 44 denotes a tab on the left, free end of panel 40, the tab joined to panel 40 by perforated line 46. The numeral 48 denotes either one of two end forming flaps, similar in structure and function to flaps 34 of panel 20.

Figure 2:
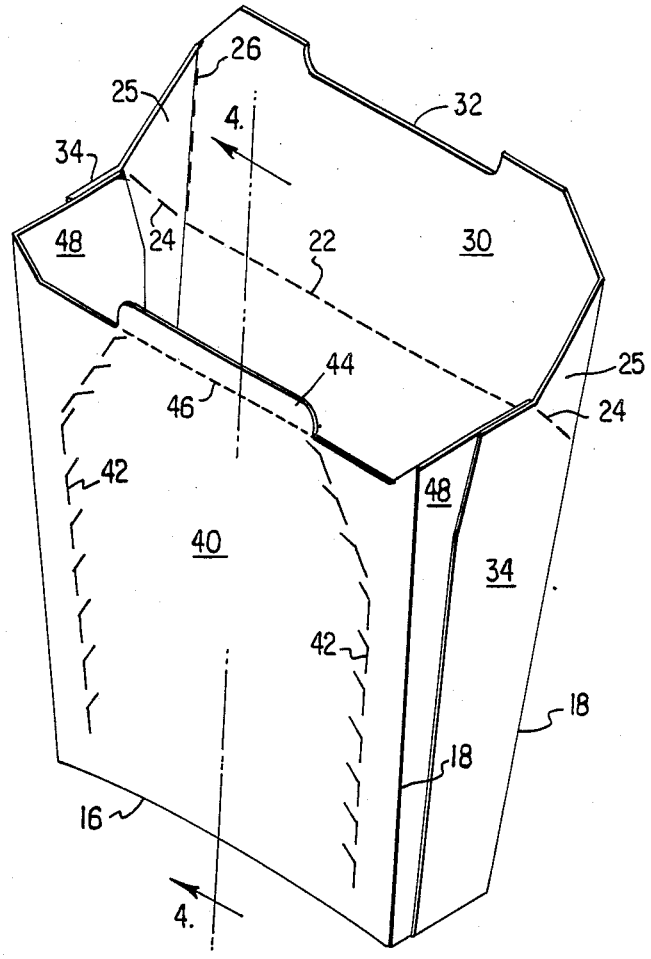
FIG. 2 is a perspective view illustrating the blank of FIG. 1 after it has been folded and glued and ready for use.

Referring now to FIG. 2 of the drawings, the blank of FIG. 1 is showing as having been erected or set up by folding side panels 20 and 40 about bottom panel 14, and gluing partially superposed or overlapped end panels 34 and 48. The configuration shown at FIG. 2 is that of a slightly tapered rectangular cone having a protruding tongue or scoop portion 30, the carton being slightly wider at its upper end or mouth than at its bottom. This construction permits the cartons to be nested prior to use if desired.

Figure 3:
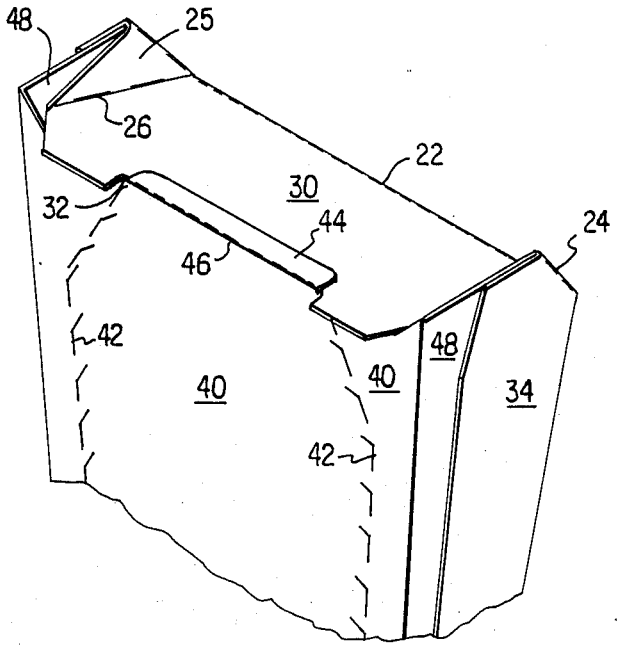
FIG. 3 is a view similar to FIG. 2, showing the protruding tongue or scoop of the carton of FIG. 2 in its snap locked configuration, closing the upper portion of the container.

In FIG. 3, sub-panel 30 has been folded about main perforated line 22 and end perforated lines 24, so that sub-panel 30 defines a top closure. Tongue 44 may, optionally, be bent about perforated line 46 so as to be received within recess 32 and thus form a somewhat loose lock or latch to maintain panel 30 in the indicated position. The configuration of FIG. 3 would represent that after the container of FIG. 2 has been loaded with french fries to a level not above the level of line 22. Triangular fold or bellows panels 25 effect a resilient snap action force between the two opposite endwalls 34, 45 and top closure 30 to maintain the latter resiliently closed, due to the resiliency of the paperboard.

Figure 4:
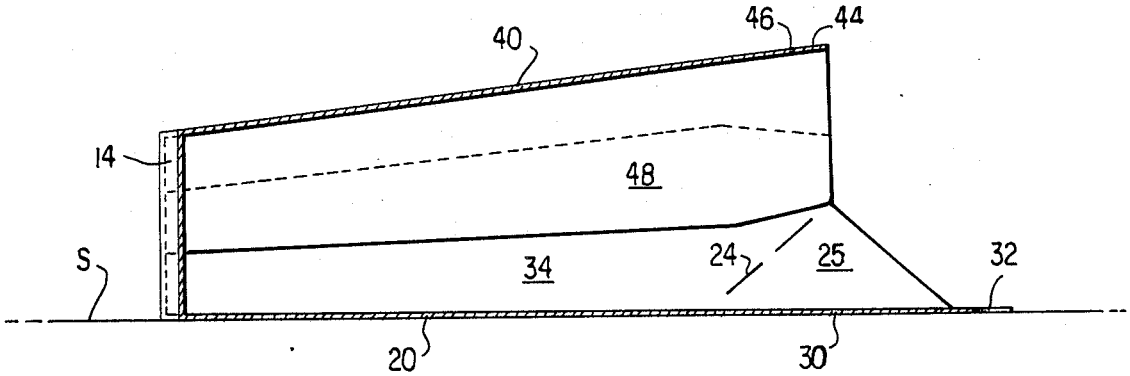
FIG. 4 is a view illustrating the carton of this invention placed on a horizontal surface, prior to opening one of its sides.
Figure 5:
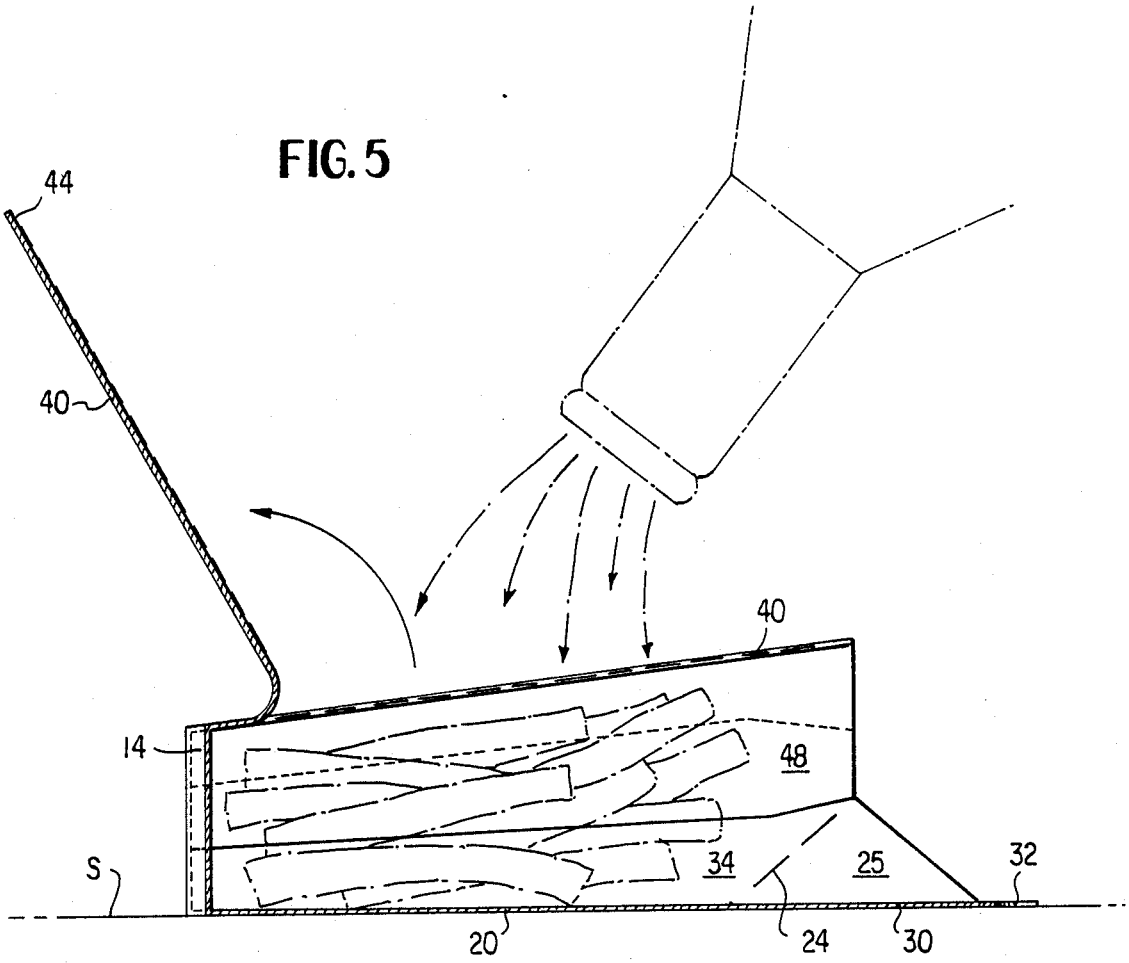
FIG. 5 is a view similar to FIG. 4 and illustrates the nearly complete ripping away of one of the sides, to thereby permit the application of a condiment to the entire mass of the french fries in the container.

Referring now to FIGS. 4 and 5 of the drawings, a consumer of the filled carton or container places it with panel 20 on a horizontal surface denoted by S. With the mouth of the container open, as indicated at FIG. 4, the user pulls tab 44, thereby ripping off a major portion of panel 40, as indicated at FIG. 5. This exposes the entire depth or stack of french fries in the container, to thereby permit the uniform application of a condiment such as ketchup from a bottle, illustrated in dashed lines at FIG. 5, to the french fries. Without the ripping or opening feature of this invention, one desirous of applying additional condiments to the french fries would have to do so from the top of the stack of french fries in the container, and such condiments would not, in general, be applied to the french fries in the bottom of the container thus requiring additional condiment applications. Tongue 44 thus functions as a pull tab to initiate ripping and as a latch means.

The terms upper, lower, right, left and the like are geometrical terms of orientation to assist in the description of the invention and are not intended as terms of limitation.

I claim:

1. A unitary blank of sheet paperboard for forming a french fry scoop/container, the blank including fold and perforated lines, the blank having a longitudinal axis of mirror symmetry, the blank having a central, bottom forming panel of generally rectangular form, a pair of sidewall forming panels foldably connected to the longitudinal edges of said central panel, one of said sidewall panels provided with a main perforated line to define a top closure sub-panel, the other of said sidewall panels being a tear panel and having a pair of generally parallel, longitudinally extending tear lines extending to that edge of said other sidewall panel remote from said central panel, each sidewall panel provided with a pair of endwall forming flaps running generally parallel to said longitudinal axis.

2. The blank of claim 1 wherein that edge of said top closure sub-panel remote from said bottom forming panel is provided with a recess and wherein that edge of said tear sidewall panel is provided with a complementary shaped tongue.

3. The blank of claim 1 wherein the longest sides of said central panel are convexly curved.

4. The blank of claim 1 said first mentioned sidewall panel has additional perforated lines which define, with edge portions of said sub-closure panel, a pair of fold panels located between respective ends of said closure sub-panel and of adjacent endwall forming flaps.

5. A french fry scoop/container formed from a unitary blank of sheet paperboard, said scoop/container having a generally rectangular bottom, a pair of sidewalls extending generally upwardly from opposite sides of said bottom, a pair of endwalls, joining the vertical edges of said sidewalls, formed from at least partially overlapping and glued together endwall flaps carried by said sidewalls, the first of said endwalls having a scoop/cover tongue coplanar with said first sidewall, the ends of said tongue including a respective fold flap, the second of said sidewalls having a pair of parallel tear lines running generally vertically and extending from the upper edge of said second sidewall to a region near said bottom, whereby said scoop/cover tongue can be snappingly folded to maintain it over the top opening of the scoop/container and whereby the filled scoop/container can be laid flat on the first sidewall and the second sidewall then ripped open to gain access to the entire scoop/container food contents.

6. The french fry scoop/container of claim 5 wherein the opposite edges of said bottom from which said sidewalls extend are convex.

7. The french fry scoop/container of claim 5 wherein said side and end walls diverge upwardly and outwardly.

* * * * *